US008848002B2

(12) United States Patent
Ryu

(10) Patent No.: US 8,848,002 B2
(45) Date of Patent: Sep. 30, 2014

(54) DISPLAY DEVICE AND DRIVING METHOD THEREOF

(75) Inventor: Do-Hyung Ryu, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 737 days.

(21) Appl. No.: 13/101,888

(22) Filed: May 5, 2011

(65) Prior Publication Data

US 2012/0038684 A1 Feb. 16, 2012

(30) Foreign Application Priority Data

Aug. 10, 2010 (KR) ..... 10-2010-0076950

(51) Int. Cl.
*G09G 5/10* (2006.01)
*G09G 3/20* (2006.01)

(52) U.S. Cl.
CPC ..... *G09G 3/20* (2013.01); *G09G 2320/0271* (2013.01); *G09G 2330/021* (2013.01); *G09G 2360/16* (2013.01); *G09G 2320/0626* (2013.01)
USPC ..... 345/690; 345/89

(58) Field of Classification Search
CPC . G09G 3/3648; G09G 3/3614; G09G 3/3688; G09G 3/3607; G09G 3/3611; G09G 3/2011
USPC ..... 345/87–89, 690
See application file for complete search history.

(56) References Cited

U.S. PATENT DOCUMENTS

2007/0195229 A1* 8/2007 Kuribayashi et al. ..... 349/106
2008/0246711 A1* 10/2008 Kobayashi ..... 345/87
2008/0278415 A1* 11/2008 Itakura et al. ..... 345/60
2010/0053039 A1* 3/2010 Park et al. ..... 345/76

FOREIGN PATENT DOCUMENTS

KR 10-2005-0037126 A 4/2005
KR 10-2007-0034457 A 3/2007
KR 10-2008-0006116 A 1/2008

* cited by examiner

*Primary Examiner* — Kimnhung Nguyen
(74) *Attorney, Agent, or Firm* — Christie, Parker & Hale, LLP

(57) ABSTRACT

A display device includes: a plurality of pixels; an image data compensator for outputting compensated image data by controlling peak luminance of image data; and a data driver for transmitting the compensated image data to the plurality of pixels, wherein the image data compensator is configured to control luminance of the image data by using a global image load of an image in its entirety, a plurality of first local image loads of a plurality of the first partitions generated by dividing the image by a first unit area, and a plurality of second local image loads of a plurality of second partitions generated by dividing the image by a second unit area. Power consumption of the display device can be reduced, and image quality is improved by improving peak luminance and contrast of the display image.

28 Claims, 7 Drawing Sheets

DISPLAY DEVICE AND DRIVING METHOD THEREOF

CROSS-REFERENCE TO RELATED APPLICATION

This application claims priority to and the benefit of Korean Patent Application No. 10-2010-0076950 filed in the Korean Intellectual Property Office on Aug. 10, 2010, the entire contents of which are incorporated herein by reference.

BACKGROUND

1. Field

Embodiments of the present invention relate to a display device and a driving method thereof.

2. Description of the Related Art

Recently, various flat panel displays have been developed which are lighter and thinner than cathode ray tubes. Various flat panel displays include a liquid crystal display (LCD), a field emission display (FED), a plasma display panel (PDP), an organic light emitting diode (OLED) display, and the like.

Among the flat panel displays, the OLED display, which displays images by using OLEDs that generate light by recombining electrons and holes, has a fast response speed, is driven with low power consumption, and has excellent emission efficiency, luminance, and viewing angle, such that it has recently been in the spot light.

The OLED includes a thin and transparent indium tin oxide (ITO) anode having a semiconductor characteristic, a metal cathode, and an organic material layer between them. The organic material layer includes a hole transport layer (HTL), an emission layer (EL), and an electron transport layer (ETL). When a voltage with a low voltage characteristic is transmitted from a power source, charges injected into holes of the anode and charges from the cathode are combined on the emission layer to generate electroluminescence on the organic material layer.

Generally, the OLED display is classified as a passive matrix type of OLED (PMOLED) or an active matrix type of OLED (AMOLED), according to how the OLEDs are driven. In aspects of resolution, contrast, and operation speed, the current trend is toward AMOLED displays in which respective unit pixels are selectively turned on or off.

One method for improving peak luminance of the AMOLED, reducing power consumption, and reducing electro-luminescence power capacity is to calculate an image load from input image data and to control the luminance of the entire display panel. The image load is the sum of the image data values for all of the pixels of the display panel. A power source voltage level for the pixel, is controlled to have various levels depending on the image loads in order to guarantee accurate operation of the pixel driving circuit. That is, the level of the power source voltage does not always need to have a relatively-high fixed value, and it is to be prepared for the maximum image load condition in which all the pixels emit as white light (peak light intensity). Average power consumption can be reduced by calculating the image load and determining the power source voltage level.

However, since the luminance of the display panel is totally controlled, the image quality of the display image may be deteriorated according to the displayed pattern for the image data.

The above information disclosed in this Background section is only for enhancement of understanding, and therefore it may contain information that does not form the prior art that is already known in this country to a person of ordinary skill in the art.

SUMMARY

Aspects of embodiments of the present invention provide a display device for reducing power consumption of a display device and improving image quality of a display image, and a driving method thereof.

An exemplary embodiment of the present invention provides a display device including: a plurality of pixels; an image data compensator for outputting compensated image data by controlling peak luminance of image data; and a data driver for transmitting the compensated image data to the plurality of pixels, wherein the image data compensator is configured to control luminance of the image data by using a global image load of an image in its entirety, a plurality of first local image loads of a plurality of first partitions generated by dividing the image by a first unit area, and a plurality of second local image loads of a plurality of second partitions generated by dividing the image by a second unit area.

The image data compensator may include: a global image load calculator for calculating the global image load; a first local image load calculator for calculating the first local image loads; a second local image load calculator for calculating the second local image loads; and a luminance calculator for controlling the peak luminance of the image data by using the global image load, the first local image loads, and the second local image loads.

The first local image load calculator may be configured to divide the image into the plurality of first partitions, and to calculate the first local image loads of the plurality of first partitions.

The first local image loads of the plurality of first partitions may be ratios of image loads of the plurality of first partitions to an average value of the image loads of the respective first partitions.

An average value of the image loads of the first partitions may be generated by dividing the global image load by a number of the plurality of first partitions.

The second local image load calculator may be configured to divide the image into the plurality of second partitions, and to calculate the second local image loads of the plurality of second partitions.

The second local image loads of the plurality of second partitions may represent ratios of the image loads of the plurality of second partitions to an average value of the image loads of the second partitions.

An average value of the image loads of the second partitions may be generated by dividing the global image load by a number of the plurality of second partitions.

The luminance calculator may be configured to set the first local image loads of the corresponding partitions as an average value of the image loads of corresponding partitions when same data are sequential between adjacent partitions in the plurality of first partitions.

The luminance calculator may be configured to set the second local image loads of the corresponding partitions as an average value of the image loads of the corresponding partitions when same data are sequential between adjacent partitions in the plurality of second partitions.

The luminance calculator may be configured to decrease the peak luminance of a first partition having a large first local image load from among the plurality of first partitions, and to increase the peak luminance of a first partition having a small first local image load from among the plurality of first partitions.

The luminance calculator may be configured to decrease the peak luminance of a second partition having a large second local image load from among the plurality of second partitions, and to increase the peak luminance of a second partition having a small second local image load from among the plurality of second partitions.

The global image load calculator may be configured to check whether or not the global image load exceeds an auto current limit threshold value, and the luminance calculator is configured to calculate the compensated image data according to a control value caused by an auto current limit when the global image load exceeds the auto current limit threshold value.

The luminance calculator may be configured to control a size of the image data by reducing the image data according to the control value caused by the auto current limit or by multiplying a coefficient.

The image data compensator may be configured to calculate the first local image loads and the second local image loads when the global image load does not exceed the auto current limit threshold value.

Another embodiment of the present invention provides a driving method for a display device to transmit compensated image data to a plurality of pixels and display an image, the method including: calculating a global image load of the image; dividing the image into a plurality of first partitions, and calculating first local image loads of the plurality of first partitions; dividing the image into a plurality of second partitions, and calculating second local image loads of the plurality of second partitions; controlling peak luminance of the plurality of first partitions and peak luminance of the plurality of second partitions; and determining peak luminance for each unit area according to controlling of the peak luminance of the plurality of first partitions and the plurality of second partitions, and outputting the compensated image data according to the peak luminance for each unit area.

The first local image loads of the plurality of first partitions may be ratios of image loads of the plurality of first partitions to an average value of the image loads for the respective first partitions.

The average value of the image loads of the first partitions may be generated by dividing the global image load by a number of the plurality of first partitions.

The second local image loads of the plurality of second partitions may be ratios of the image loads of the plurality of second partitions to an average value of the image loads of the second partitions.

The average value of the image loads of the second partitions may be generated by dividing the global image load by a number of the plurality of second partitions.

The method further may further include checking whether or not the global image load exceeds an auto current limit threshold value after calculating the global image load.

Additionally, when the global image load exceeds the auto current limit threshold value, a size of the image data may be controlled by reducing the image data according to a control value caused by an auto current limit or by multiplying a coefficient.

And, when the global image load does not exceed the auto current limit threshold value, the first local image loads and the second local image loads may be calculated.

Controlling of the peak luminance of the plurality of first partitions and the peak luminance of the plurality of second partitions may include determining whether or not same data are sequential between adjacent partitions in the plurality of first partitions and the plurality of second partitions.

When the same data are sequential between the adjacent partitions in the plurality of first partitions, the first local image loads of the corresponding partitions may be set with an average value of the image loads of the corresponding partitions.

When the same data are sequential between the adjacent partitions in the plurality of second partitions, the second local image loads of the corresponding partitions may be set with an average value of the image loads of the corresponding partitions.

The peak luminance of a first partition having a large first local image load from among the plurality of first partitions may be decreased, and the peak luminance of a first partition having a small first local image load from among the plurality of partitions may be increased.

The peak luminance of a second partition having a large second local image load from among the plurality of second partitions may be decreased, and the peak luminance of a second partition having a small second local image load from among the plurality of partitions may be increased.

DETAILED DESCRIPTION

Figure 1:
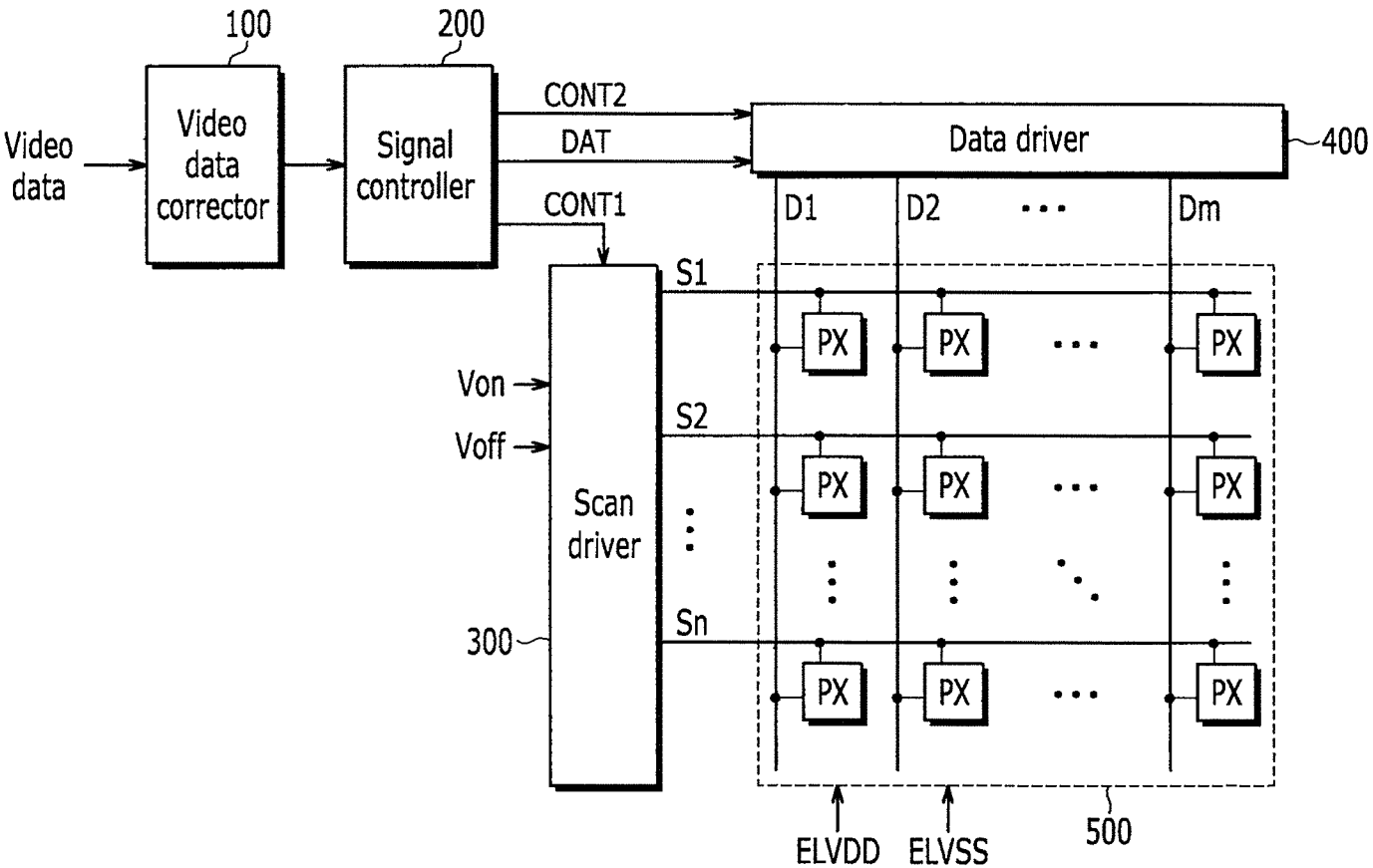
FIG. 1 shows a block diagram of a display device according to an exemplary embodiment of the present invention.

Hereinafter, certain exemplary embodiments according to the present invention will be described more fully hereinafter with reference to the accompanying drawings. As those skilled in the art would realize, the described exemplary embodiments may be modified in various different ways, all without departing from the spirit or scope of the present invention. The drawings and description are to be regarded as illustrative in nature and not restrictive.

Further, like reference numerals denotes like elements throughout the specification. A first exemplary embodiment will be representatively described, and therefore only components other than those of the first exemplary embodiment will be described in other exemplary embodiments.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements, but not the exclusion of any other elements.

FIG. 1 shows a block diagram of a display device according to an exemplary embodiment of the present invention.

Referring to FIG. 1, the display device includes an image data compensator 100, a signal controller 200, a scan driver 300, a data driver 400, and a display 500.

The image data compensator 100 outputs compensated image data by controlling peak luminance of the image data input by an external device. The image data have luminance information of respective pixels (PX), and the luminance has a number (e.g., a predetermined number) of grayscales (e.g., gray scale levels or gray levels), for example, $1024=2^{10}$, $256=2^{8}$, or $64=2^{6}$. The image data compensator 100 controls the peak luminance of the image data by using a global image load of one image, a first local image load of a first partition of the image, and a second local image load of a second partition.

The signal controller 200 receives compensated image data from the image data compensator 100. The signal controller 200 processes the compensated image data according to operational conditions of the display 500 and the data driver 400, and generates a control signal (CONT1), a data control signal (CONT2,) and an image data signal (DAT). The signal controller 200 transmits the scan control signal (CONT1) to the scan driver 300. The signal controller 200 transmits the data control signal (CONT2) and the image data signal (DAT) to the data driver 400.

The display 500 includes a plurality of pixels (PX) connected to a plurality of scan lines S1-Sn, a plurality of data lines D1-Dm, and a plurality of signal lines (S1-Sn, D1-Dm), and are arranged in a matrix form (e.g., rows and columns). The plurality of scan lines S1-Sn are extended in a row direction and are in parallel with each other. The plurality of data lines D1-Dm are extended in a column direction and are in parallel with each other. The plurality of pixels (PX) of the display 500 externally receives a first power source voltage (ELVDD) level and a second power source voltage (ELVSS) level.

The scan driver 300 is connected to a plurality of scan lines S1-Sn, and applies a scan signal that is a combination of a gate-on voltage (Von) for applying the data signal to the pixel (PX) and a gate-off voltage (Voff) for intercepting the same according to the scan control signal (CONT1) to a plurality of scan lines S1-Sn. The scan driver 300 sequentially transmits the scan signal to a plurality of pixels (PX) according to the scan control signal (CONT1) to apply the data signal to the pixels (PX).

The data driver 400 is connected to a plurality of data lines D1-Dm, and selects a gray voltage level according to the image data signal (DAT). The data driver 400 applies the gray voltage level selected according to the data control signal (CONT2) as a data signal to a plurality of data lines D1-Dm. That is, the data driver 400 transmits the compensated image data that are generated by controlling the peak luminance by the image data compensator 100 to the pixels (PX).

The display device is driven by including the scan interval for applying a data signal to the pixel (PX) included in the display 500 and a sustain interval for emitting the pixels (PX).

The display device performs an auto current limit (ACL) function for reducing power consumption of the display 500. The auto current limit performs an analysis process for finding average brightness for the image data that are input to the display device for a specific period, and controls the current through a hardwired or software manner. The hardwired auto current limit includes a process for temporally turning on/off the display of images according to the analysis result of the image data. The software auto current limit includes a process for controlling the data size while displaying the image data on the screen according to the image data analysis result.

The above-described driving devices (100, 200, 300, 400) can be directly installed on the display 500 in at least one integrated circuit chip form, installed on a flexible printed circuit film, attached to the display 500 in a tape carrier package (TCP) form, installed on an additional printed circuit board (PCB), or integrated in the display 500 together with the signal lines (S1-Sn, D1-Dm).

Figure 2:
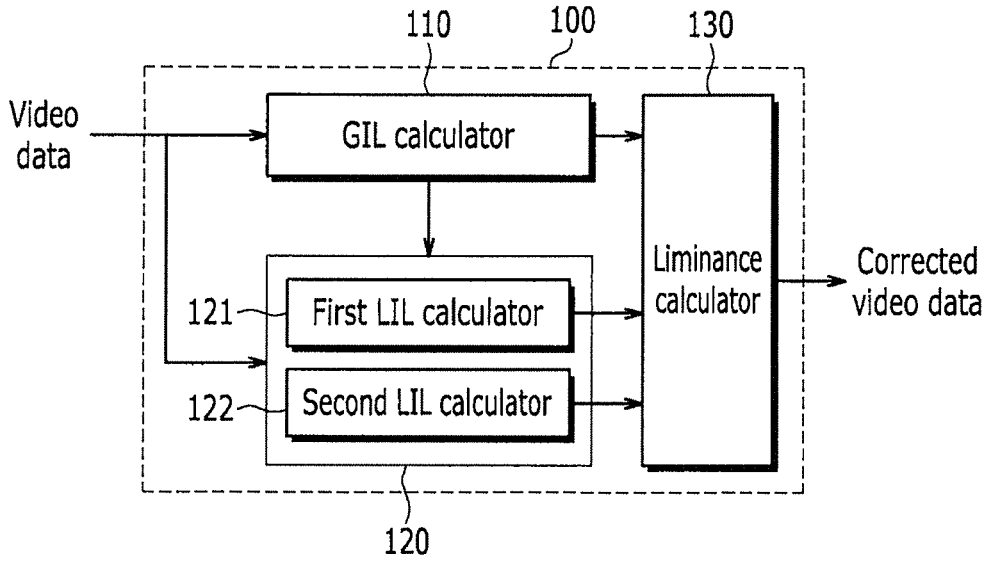
FIG. 2 shows a block diagram of an image data compensator according to an exemplary embodiment of the present invention.

FIG. 2 shows a block diagram of an image data compensator according to an exemplary embodiment of the present invention.

Referring to FIG. 2, the image data compensator 100 includes a global image load (GIL) calculator 110, a local image load calculator 120, and a luminance calculator 130.

The global image load calculator 110 calculates a global image load of one image. The image load is the sum of the image data values. The global image load calculator 110 transmits the calculated global image load to the local image load calculator 120 and the luminance calculator 130. The global image load calculator 110 checks whether the global image load exceeds an auto current limit (ACL) threshold value, and transmits it to the local image load calculator 120 and the luminance calculator 130.

The local image load calculator 120 includes a first local image load calculator 121 and a second local image load calculator 122.

The first local image load calculator 121 divides an image into a plurality of first partitions, and calculates first local image loads of the first partitions. The first local image loads of the first partitions represent ratios of the image load of the first partitions to the average value of the image loads for the respective first partitions. The average value is found by dividing the global image load provided by the global image load calculator 110 by the number of the first partitions. The first local image load calculator 121 transmits the first local image loads of the calculated first partitions to the luminance calculator 130.

The second local image load calculator 122 divides one image into a plurality of second partitions, and calculates second local image loads of the plurality of second partitions. The respective second local image loads of the second partitions represent the ratio of the image loads of the second partitions to the average value of the image loads for respective second partitions. The average value is acquired by dividing the global image load provided by the global image load calculator 110 by a number of a plurality of second partitions. The second local image load calculator 122 transmits the second local image loads of the calculated second partitions to the luminance calculator 130.

The first partition and the second partition have different areas (e.g., volumes). That is, the first local image load calculator 121 and the second local image load calculator 122 divide one image into different areas (e.g., volumes) to calculate the local image loads of the respective partitions. The local image load calculator 120 calculates the first local image load and the second local image load when the global image load does not exceed the auto current limit threshold value, and it may not calculate the first local image load and the second local image load when the global image load exceeds the auto current limit threshold value.

When the global image load exceeds the auto current limit threshold value, the luminance calculator 130 outputs compensated image data according to a control value caused by the auto current limit. The auto current limit threshold value indicates a reference value for determining whether to perform the auto current limit function in a hardwired or software manner. For example, the luminance calculator 130 controls the size of the image data by reducing the whole image data by a predetermined value according to the control value caused by the auto current limit or multiplying a specific coefficient, and outputs the controlled image data as compensated image data.

When the global image load does not exceed the auto current limit threshold value, the luminance calculator 130 controls the peak luminance of the plurality of first partitions through the correlation of the first local image loads of the plurality of first partitions, and controls the peak luminance of the respective second partitions through the correlation of second local image loads of a plurality of second partitions.

In this instance, when the same data are continuously (e.g., sequentially) provided between adjacent partitions from among a plurality of first partitions, the luminance calculator 130 sets the first local image loads of the corresponding partitions as the average value of the first local image loads of the corresponding partitions. When the same data are continuously provided between adjacent partitions from among a plurality of second partitions, the luminance calculator 130 sets the second local image loads of the corresponding partitions to an average value of the second local image loads of the corresponding partitions in order to prevent generation of a boundary between the partitions while controlling luminance of the respective partitions.

The peak luminance per minimum unit area (e.g., the first partition) is determined according to controlling of the peak luminance of the first partitions and the peak luminance of the second partitions. For example, the luminance calculator 130 controls the peak luminance of a plurality of first partitions and controls the peak luminance of a plurality of second partitions to control the peak luminance per minimum unit area of the image. The luminance calculator 130 generates the compensated image data by controlling the grayscales (e.g., the gray scale level or gray levels) of the image data according to the peak luminance per minimum unit area of the image.

For controlled power consumption, the peak pixel current of each pixel is reduced when the image load is increased, and the peak pixel current is increased when the image load is decreased. When the image load is increased, the peak pixel current is reduced, the peak luminance is reduced, and the luminance ratio for the grayscale level of the image data is reduced. When the image load is decreased, the peak pixel current is increased, the peak luminance is increased, and the luminance ratio of the grayscale level of the image data is increased. The relationship of the luminance ratio for the grayscale level of the image data according to the peak luminance value can be configured as a lookup table. The luminance calculator 130 selects a grayscale level of the image data of the determined peak luminance from the lookup table, and outputs the compensated image data. That is, the grayscale level of the input image data is corrected by the grayscale level that is changed by the peak luminance determined by the image load.

Figure 3:
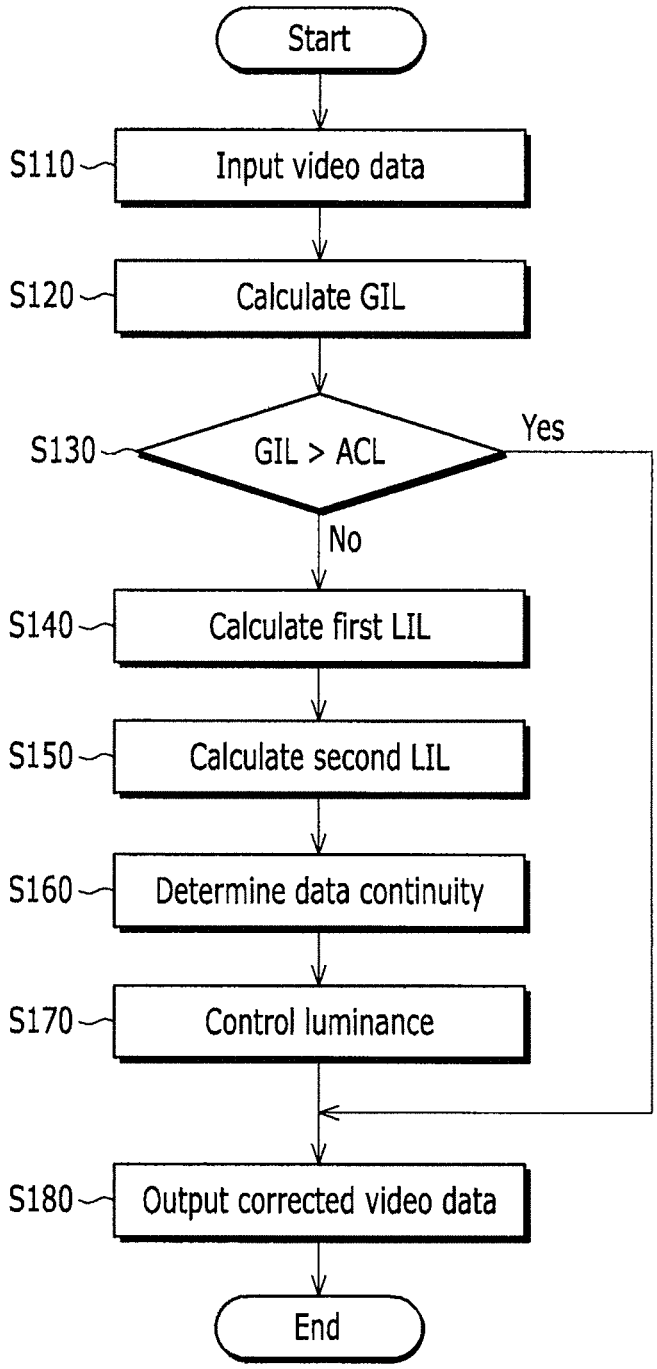
FIG. 3 shows a flowchart of a method for generating compensated image data according to an exemplary embodiment of the present invention.

FIG. 3 shows a flowchart of a method for generating compensated image data according to an exemplary embodiment of the present invention.

Referring to FIG. 3, when the image data compensator 100 receives image data from an external device (S110), the global image load calculator 110 calculates the global image load of one image (S120). The image load is equal to the sum of the image data values, and the global image load is equal to the sum of entire image data values forming one image.

The global image load calculator 110 determines whether the global image load (GIL) exceeds the auto current limit (ACL) threshold value (S130).

When the global image load does not exceed the auto current limit threshold value, the first local image load calculator 121 divides one image into a plurality of first partitions, and calculates first local image loads of the first partitions (S140). In this instance, the first local image load calculator 121 calculates the average value of the image loads for the respective first partitions by dividing the global image load transmitted by the global image load calculator 110 by the number of the first partitions, and calculates the ratio of the respective image loads of the first partitions to the average value of the image loads for the respective first partitions.

When the global image load does not exceed the auto current limit threshold value, the second local image load calculator 122 divides one image into a plurality of second partitions, and calculates second local image loads of the second partitions (S150). In this instance, the second local image load calculator 122 calculates the average value of the image loads for the second partitions by dividing the global image load transmitted by the global image load calculator 110 by the number of the second partitions, and calculates the ratio of the respective image loads of the second partitions to the average value of the image loads for the second partitions.

The luminance calculator 130 determines data continuity for indicating whether the same data are sequentially (e.g., continuously) provided between the partitions, from among the first partitions and the second partitions (S160), in order to prevent a border line between the partitions when the peak luminance of the respective partitions are controlled.

The luminance calculator 130 controls the peak luminance of the first partitions through the correlation of the respective first local image loads of the first partitions, and controls the peak luminance of the second partitions through the correlation of the respective second local image loads of the second partitions (S170). The luminance calculator 130 increases or decreases the peak luminance of the first partitions and the second partitions. In this instance, when the same data are continuously provided among the neighboring partitions, the luminance calculator 130 sets the local image load of the corresponding partition to the average value of the local image load of the corresponding partition.

The luminance calculator 130 selects the grayscale level of the image data determined for the peak luminance from the lookup table and outputs the compensated image data (S180).

In addition, when the global image load exceeds the auto current limit threshold value, the first local image load and the second local image load are not calculated, and the luminance calculator 130 outputs the compensated image data according to the control value following the auto current limit.

A method for controlling peak luminance of a plurality of first partitions and a plurality of second partitions according to an embodiment will now be described in further detail.

Figure 4:
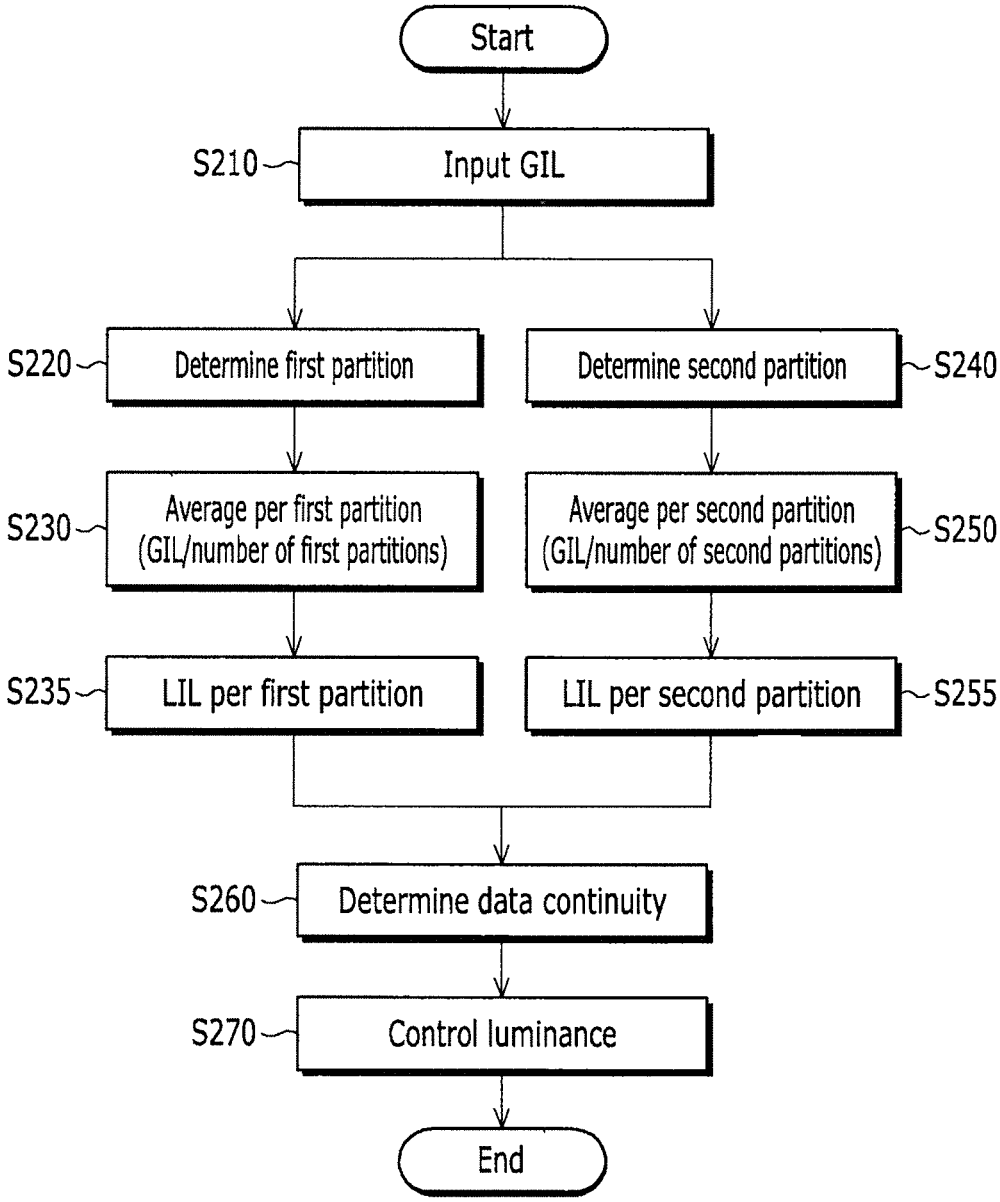
FIG. 4 shows a flowchart of a method for controlling luminance using a partial image load according to an exemplary embodiment of the present invention.
Figure 5:
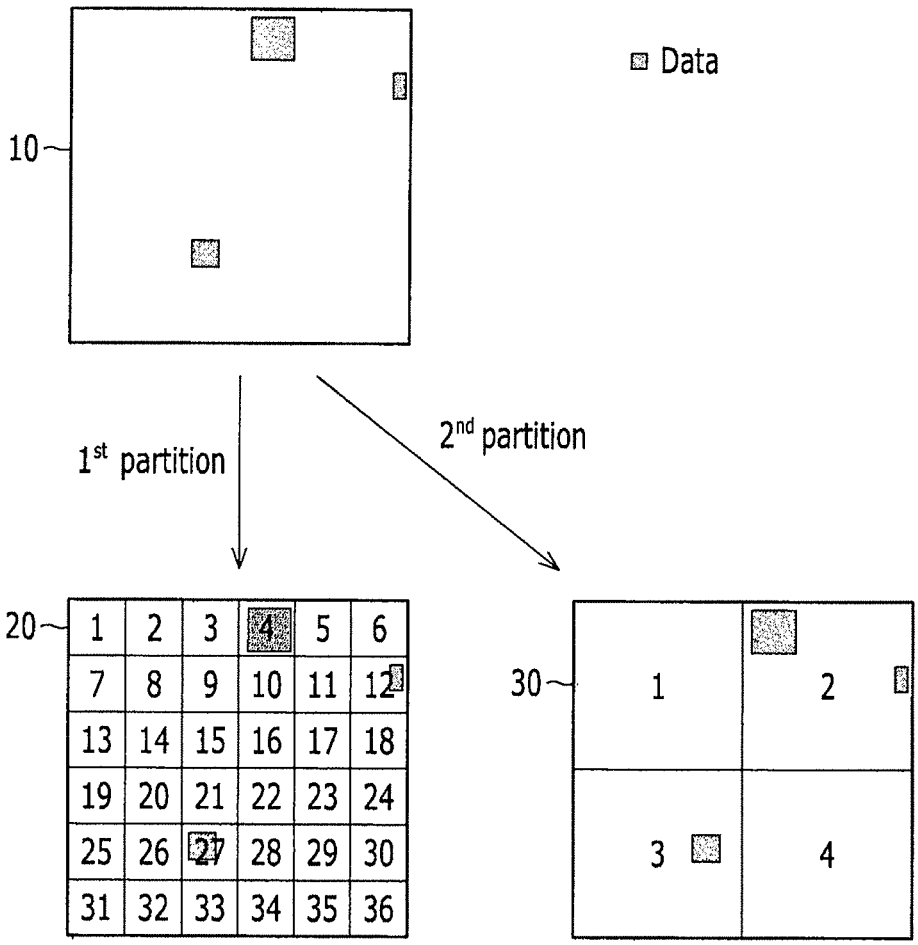
FIG. 5 shows a method for controlling luminance for an example image using a local image load according to an exemplary embodiment of the present invention.

FIG. 4 shows a flowchart of a method for controlling luminance using a partial image load according to an exemplary embodiment of the present invention. FIG. 5 shows a method for controlling luminance for a sample image using a local image load according to an exemplary embodiment of the present invention.

Referring to FIGS. 4 and 5, the global image load generated by the global image load calculator 110 is input to the first local image load calculator 121 and the second local image load calculator 122 (S210).

The first local image load calculator 121 determines first partition divisions by dividing one image into a plurality of first partitions (S220), and the second local image load calculator 122 determines second partition divisions by dividing one image into a plurality of second partitions (S240). The first local image load calculator 121 and the second local image load calculator 122 divide one image into different areas (e.g., volumes) of the first partitions and the second partitions.

For example, in FIG. 5, one image 10 is divided into 6×6 first partitions and 4×4 second partitions. The image 10 includes data that can be included in at least one first partition (4th, 12th, and 27th first partitions) from among the divided first partitions and at least one second partition (2nd and 3rd second partitions) from among the second partitions.

The first local image load calculator 121 calculates the average value of the image load for each first partition (S230). The average value of the image load for each first partition is found by dividing the global image load (GIL) by the number of first partitions. In FIG. 5, the average value of the image load per first partition 20 is GIL/36 (i.e., 36 first partitions).

The first local image load calculator 121 calculates the first local image loads of the first partitions (S235). The first local image loads of the plurality of first partitions are calculated with the ratio for the average value of the image loads for the respective first partitions. In the case of FIG. 5, the first local image loads of the first partitions 20 are calculated as a percent value (%) for GIL/36 (i.e., 36 first partitions).

The second local image load calculator 122 calculates the average value of the image loads for the respective second partitions (S250). The average value of the image loads for the respective second partitions are found by dividing the global image load (GIL) by the number of the second partitions. In the instance of FIG. 5, the average value of the image load for the respective second partitions 30 is GIL/4 (i.e., 4 second partitions).

The second local image load calculator 122 calculates the second local image loads of the plurality of second partitions (S255). The second local image loads of the second partitions are calculated with the ratio for the average value of the image loads for the respective second partitions. In the example of FIG. 5, the second local image loads of a plurality of the second partitions 30 are calculated as the percent value (%) of GIL/4 (i.e., 4 second partitions).

The calculated first local image loads of the first partitions and the second local image loads of the second partitions are transmitted to the luminance calculator 130, and the luminance calculator 130 determines data continuity of the first partitions and the second partitions (S260). When the same data are sequentially provided between the adjacent partitions, the luminance calculator 130 sets the local image load of the corresponding partition as an average value of the local image load of the corresponding partition in order to prevent generation of a border line between the partitions. In FIG. 5, since the same data are not sequentially provided between the adjacent partitions from among the plurality of the first partitions 20 or the plurality of the second partitions 30, the peak luminance is controlled with reference to the local image load of each partition.

The luminance calculator 130 controls the peak luminance of a plurality of the first partitions through the correlation among the first local image loads of a plurality of the first partitions, and controls the peak luminance of a plurality of the second partitions through the correlation of the second local image loads of a plurality of the second partitions (S270).

In the case of FIG. 5, the 4th, 12th, and 27th first partitions have data from among a plurality of the first partitions 20, and the 2nd and 3rd second partitions have data from among a plurality of the second partitions 30. Regarding the plurality of the first partitions 20, the peak luminance of the 12th first partition, having relatively less data, is increased, and the peak luminance of the 4th first partition, having relatively more data, is reduced. Regarding a plurality of the second partitions 30, the peak luminance of the 3rd second partition, having relatively less data, is increased. Therefore, the peak luminance of the 27th first partition positioned in the 3rd second partition becomes greater than the case in which the global image load and the first local image load are applied. The peak luminance of the 4th first partition provided in the 2nd second partition area becomes less than the case in which the global image load and the first local image load are applied. Accordingly, the peak luminance of the 12th first partition and the 3rd second partition, having relatively less data, can be increased instead of reducing the peak luminance of the 4th first partition, having relatively more data.

The peak luminance and the contrast are improved, and image quality is further accurately improved since the peak luminance is controlled for respective partitions based on the correlation of the local image loads of a plurality of partitions compared to the case of correcting the image data according to the auto current limit or totally controlling the luminance of the display panel according to the global image load.

Figure 6:
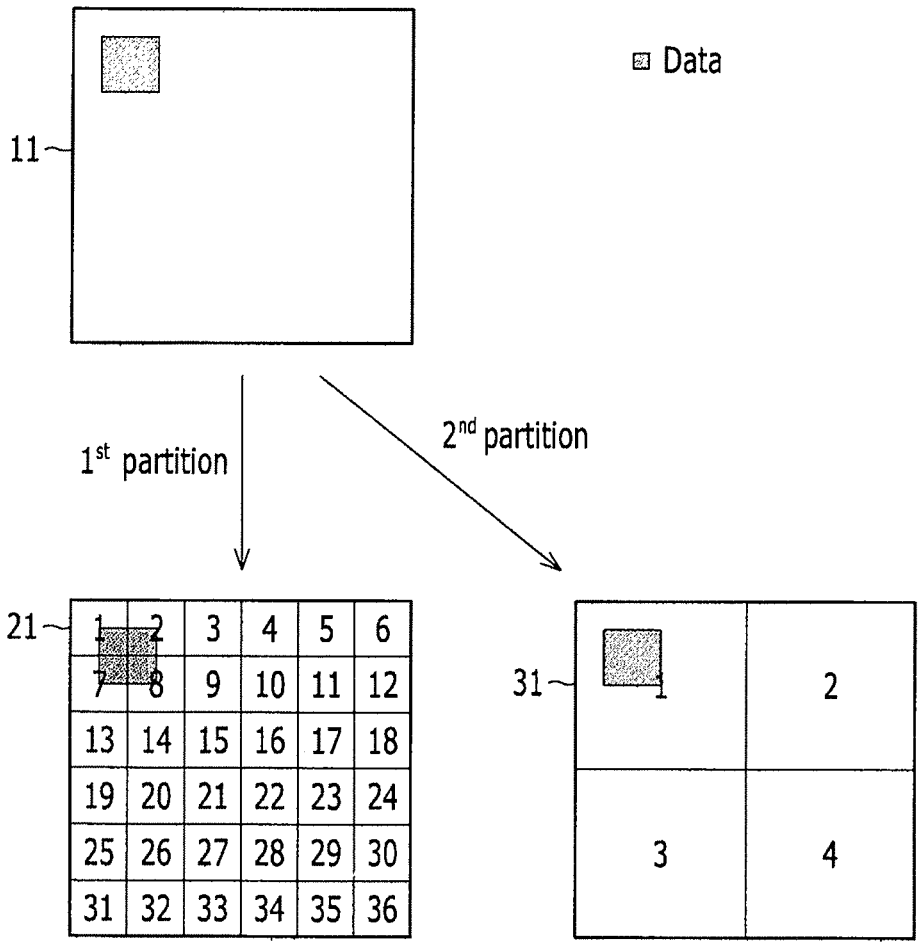
FIG. 6 shows a method for controlling luminance for an example image using a local image load according to another exemplary embodiment of the present invention.

FIG. 6 shows a method for controlling luminance for a second example image using a local image load according to another exemplary embodiment of the present invention.

Referring to FIG. 6, the data included in the image 11 are positioned in the 1st, 2nd, 7th, and 8th first partitions from among a plurality of the first partitions 21, and are positioned in the 1st second partition from among a plurality of the second partitions 31.

In this case, the same data are provided in sequence to a plurality of the adjacent first partitions (e.g., to the 1st, 2nd, 7th and 8th first partitions). The luminance among the first partitions may look non-uniform by controlling the peak luminance of one of the first partitions. Therefore, when the same data are continuous between the adjacent first partitions, the local image load of the first partitions (e.g., the 1st, 2nd, 7th, and 8th first partitions) is set to the average of the local image loads for the corresponding first partitions with the same data (e.g., the 1st, 2nd, 7th, and 8th first partitions).

For example, in the example illustrated in FIG. 6, containing 36 first partitions, when the local image load of the 1st first partition is calculated as a % for GIL/36, the local image load of the 2nd first partition is b % for GIL/36, the local image load of the 7th first partition is c % for GIL/36, and the local image load of the 8th first partition is d % for GIL/36, the local image loads of the 1st, 2nd, 7th, and 8th first partitions are each set to be (a+b+c+d)/4 percent (%).

When the same data are continuous at a plurality of partitions, the local image load of the corresponding partition is set to be the average value of the local image loads of the corresponding partition, and no border line is generated between the partitions.

Figure 7:
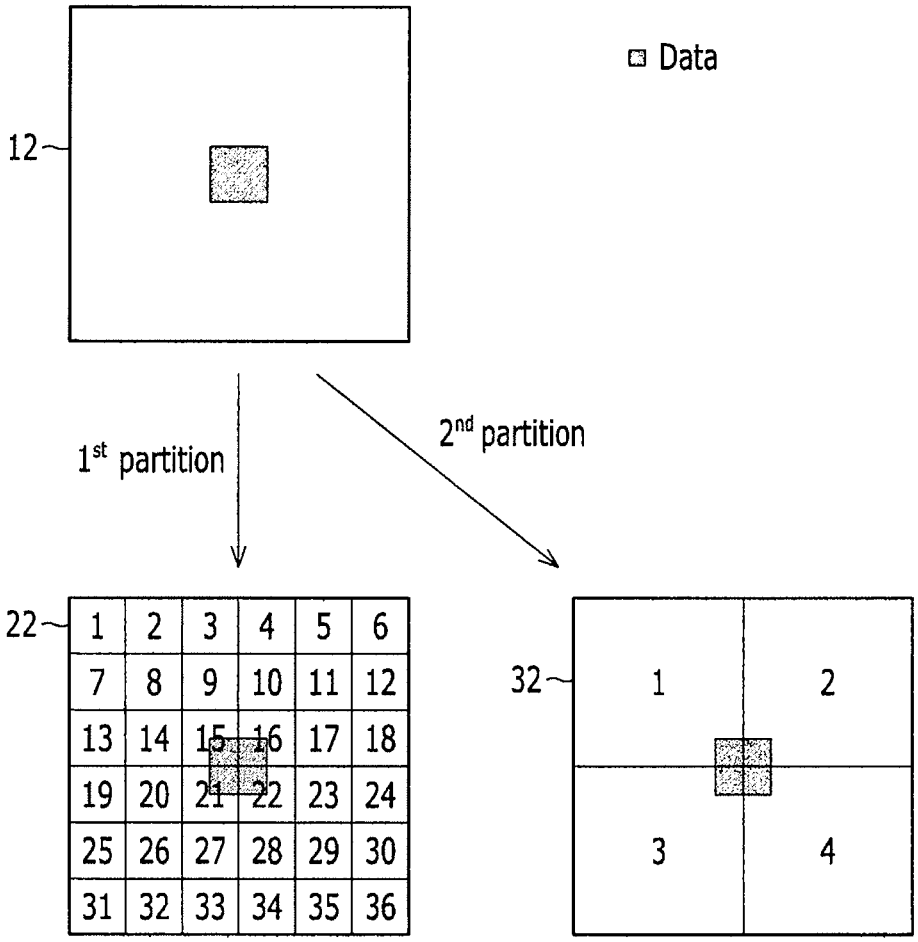
FIG. 7 shows a method for controlling luminance for an example image using a local image load according to the other exemplary embodiment of the present invention.

FIG. 7 shows a method for controlling luminance for a third example image using a local image load according to the other exemplary embodiment of the present invention.

Referring to FIG. 7, the data included in the image 12 are positioned at the 15th, 16th, 21st, and 22nd first partitions from among a plurality of the first partitions 22, and they are positioned at the 1st, 2nd, 3rd, and 4th second partitions from among a plurality of the second partitions 32.

Since the same data are continuous between the adjacent first partitions, the local image load of the 15th, 16th, 21st, and 22nd first partitions are set to be the average value of the local image loads of the 15th, 16th, 21st, and 22nd first partitions. Since the same data are continuous between the adjacent second partitions, the local image loads of the 1st, 2nd, 3rd, and 4th second partitions are set to be the average value of the local image loads of the 1st, 2nd, 3rd, and 4th second partitions.

As described above, power consumption is reduced, the peak luminance and the contrast of the display image are improved, and image quality deterioration is reduced or prevented by controlling the peak luminance according to the local image loads for respective partitions with reference to the first partition and the second partition, detecting the power consumption between the minimum unit area (the first partition) and the upper unit area (the second partition) and the correlation between luminance, and correcting the image data instead of calculating the global image load and controlling the display brightness.

Although exemplary embodiments of the present invention, are described herein, they are by way of example only and the present invention is not limited thereto. A person of ordinary skill in the art may change or modify the described exemplary embodiment without departing from the scope of the present invention, and the change or modification are also included in the scope of the present invention. Therefore, the scope of the present invention should be defined by the appended claims and equivalents, and not merely by the described exemplary embodiments.

What is claimed is:

1. A display device comprising:

a plurality of pixels;

an image data compensator for outputting compensated image data by controlling peak luminance of image data; and a data driver for transmitting the compensated image data to the plurality of pixels, wherein the image data compensator is configured to control luminance of the image data by using a global image load of an image in its entirety, a plurality of first local image loads of a plurality of first partitions generated by dividing the image by a first unit area, and a plurality of second local image loads of a plurality of second partitions generated by dividing the image by a second unit area.

2. The display device of claim 1, wherein the image data compensator comprises:

a global image load calculator for calculating the global image load;

a first local image load calculator for calculating the first local image loads;

a second local image load calculator for calculating the second local image loads; and a luminance calculator for controlling the peak luminance of the image data by using the global image load, the first local image loads, and the second local image loads.

3. The display device of claim 2, wherein the first local image load calculator is configured to divide the image into the plurality of first partitions, and to calculate the first local image loads of the plurality of first partitions.

4. The display device of claim 3, wherein the first local image loads of the plurality of first partitions are ratios of image loads of the plurality of first partitions to an average value of the image loads of the respective first partitions.

5. The display device of claim 4, wherein an average value of the image loads of the first partitions is generated by dividing the global image load by a number of the plurality of first partitions.

6. The display device of claim 3, wherein the second local image load calculator is configured to divide the image into the plurality of second partitions, and to calculate the second local image loads of the plurality of second partitions.

7. The display device of claim 6, wherein the second local image loads of the plurality of second partitions represent ratios of the image loads of the plurality of second partitions to an average value of the image loads of the second partitions.

8. The display device of claim 7, wherein an average value of the image loads of the second partitions is generated by dividing the global image load by a number of the plurality of second partitions.

9. The display device of claim 6, wherein the luminance calculator is configured to set the first local image loads of the corresponding partitions as an average value of the image loads of corresponding partitions when same data are sequential between adjacent partitions in the plurality of first partitions.

10. The display device of claim 9, wherein the luminance calculator is configured to set the second local image loads of the corresponding partitions as an average value of the image loads of the corresponding partitions when same data are sequential between adjacent partitions in the plurality of second partitions.

11. The display device of claim 6, wherein the luminance calculator is configured to decrease the peak luminance of a first partition having a large first local image load from among the plurality of first partitions, and to increase the peak luminance of a first partition having a small first local image load from among the plurality of first partitions.

12. The display device of claim 6, wherein the luminance calculator is configured to decrease the peak luminance of a second partition having a large second local image load from among the plurality of second partitions, and to increase the peak luminance of a second partition having a small second local image load from among the plurality of second partitions.

13. The display device of claim 2, wherein the global image load calculator is configured to check whether or not the global image load exceeds an auto current limit threshold value, and the luminance calculator is configured to calculate the compensated image data according to a control value caused by an auto current limit when the global image load exceeds the auto current limit threshold value.

14. The display device of claim 13, wherein the luminance calculator is configured to control a size of the image data by reducing the image data according to the control value caused by the auto current limit or by multiplying a coefficient.

15. The display device of claim 13, wherein the image data compensator is configured to calculate the first local image loads and the second local image loads when the global image load does not exceed the auto current limit threshold value.

16. A driving method for a display device to transmit compensated image data to a plurality of pixels and display an image, the method comprising:

calculating a global image load of the image;

dividing the image into a plurality of first partitions generated by dividing the image by a first unit area, and calculating first local image loads of the plurality of first partitions;

dividing the image into a plurality of second partitions generated by dividing the image by a second unit area, and calculating second local image loads of the plurality of second partitions, wherein the first and second unit areas are differently sized;

controlling peak luminance of the plurality of first partitions and peak luminance of the plurality of second partitions; and determining peak luminance for each unit area according to controlling of the peak luminance of the plurality of first partitions and the plurality of second partitions, and outputting the compensated image data according to the peak luminance for each unit area.

17. The method of claim 16, wherein the first local image loads of the plurality of first partitions are ratios of image loads of the plurality of first partitions to an average value of the image loads for the respective first partitions.

18. The method of claim 17, wherein the average value of the image loads of the first partitions is generated by dividing the global image load by a number of the plurality of first partitions.

19. The method of claim 16, wherein the second local image loads of the plurality of second partitions are ratios of the image loads of the plurality of second partitions to an average value of the image loads of the second partitions.

20. The method of claim 19, wherein the average value of the image loads of the second partitions is generated by dividing the global image load by a number of the plurality of second partitions.

21. The method of claim 16, further including checking whether or not the global image load exceeds an auto current limit threshold value after calculating the global image load.

22. The method of claim 21, wherein when the global image load exceeds the auto current limit threshold value, a size of the image data is controlled by reducing the image data according to a control value caused by an auto current limit or by multiplying a coefficient.

23. The method of claim 21, wherein when the global image load does not exceed the auto current limit threshold value, the first local image loads and the second local image loads are calculated.

24. The method of claim 16, wherein the controlling of the peak luminance of the plurality of first partitions and the peak luminance of the plurality of second partitions comprises determining whether or not same data are sequential between adjacent partitions in the plurality of first partitions and the plurality of second partitions.

25. The method of claim 24, wherein when the same data are sequential between the adjacent partitions in the plurality of first partitions, the first local image loads of the corresponding partitions are set with an average value of the image loads of the corresponding partitions.

26. The method of claim 24, wherein when the same data are sequential between the adjacent partitions in the plurality of second partitions, the second local image loads of the corresponding partitions are set with an average value of the image loads of the corresponding partitions.

27. The method of claim 16, wherein the peak luminance of a first partition having a large first local image load from among the plurality of first partitions is decreased, and the peak luminance of a first partition having a small first local image load from among the plurality of partitions is increased.

28. The method of claim 16, wherein the peak luminance of a second partition having a large second local image load from among the plurality of second partitions is decreased, and the peak luminance of a second partition having a small second local image load from among the plurality of partitions is increased.

* * * * *